US011472145B2

(12) United States Patent
Kolbe et al.

(10) Patent No.: US 11,472,145 B2
(45) Date of Patent: Oct. 18, 2022

(54) ROTOR FOR A ROTARY PRESS

(71) Applicant: Fette Compacting GmbH, Schwarzenbek (DE)

(72) Inventors: Sven Kolbe, Buechen (DE); Jan Naeve, Gudow (DE); Frank Schade, Tramm (DE)

(73) Assignee: Fette Compacting GmbH, Schwarzenbek (DE)

( * ) Notice: Subject to any disclaimer, the term of this patent is extended or adjusted under 35 U.S.C. 154(b) by 85 days.

(21) Appl. No.: 16/567,111

(22) Filed: Sep. 11, 2019

(65) Prior Publication Data

US 2020/0086598 A1 Mar. 19, 2020

(30) Foreign Application Priority Data

Sep. 13, 2018 (DE) ..... 10 2018 122 394.3

(51) Int. Cl.

*B30B 15/00* (2006.01)
*B30B 11/08* (2006.01)
*B30B 11/10* (2006.01)

(52) U.S. Cl.

CPC ..... *B30B 15/0082* (2013.01); *B30B 11/08* (2013.01); *B30B 11/085* (2013.01); *B30B 11/10* (2013.01)

(58) Field of Classification Search

CPC ... B30B 15/0082; B30B 11/08; B30B 11/085; B30B 11/10

See application file for complete search history.

(56) References Cited

U.S. PATENT DOCUMENTS 3,332,367 A * 7/1967 Sperry ..... B30B 11/08 264/297.6
8,025,498 B2 * 9/2011 Haase ..... B30B 11/085 425/345
9,561,634 B2 * 2/2017 Kolbe ..... B30B 15/304
2008/0029915 A1 2/2008 Waldron (Continued)

FOREIGN PATENT DOCUMENTS

CN 101612810 A 12/2009
CN 101612815 A 12/2009

(Continued)

OTHER PUBLICATIONS

EP 19190057.0; European Search Report; dated Nov. 18, 2019 (8 Pages).

*Primary Examiner* — Seyed Masoud Malekzadeh
(74) *Attorney, Agent, or Firm* — Barclay Damon LLP

(57) ABSTRACT

A rotor for a rotary press comprises a die plate, upper punch seats, and lower punch seats configured to be rotationally driven by a rotary drive. An annular discharge channel is configured to be in a fixed position with respect to the die plate and further configured to collect product residue from at least one of the die plate and the lower punch seat. The discharge channel additionally comprises a removal region where the product residue is configured to be removed from the annular discharge channel A catch element is configured to rotate in sync with the die plate and is guided within the annular discharge channel to convey the product residue collected in the annular discharge channel to the removal region.

12 Claims, 2 Drawing Sheets

(56) References Cited

U.S. PATENT DOCUMENTS

| | | | | |
|---|---|---|---|---|
| 2014/0314895 | A1* | 10/2014 | Kolbe | B30B 15/08 425/218 |
| 2016/0271067 | A1* | 9/2016 | Marius | A23P 10/25 |
| 2016/0303816 | A1 | 10/2016 | Luedemann | |
| 2018/0178474 | A1* | 6/2018 | Vogeleer | B30B 11/08 |
| 2019/0193309 | A1* | 6/2019 | Kitamura | B30B 15/0088 |

FOREIGN PATENT DOCUMENTS

| | | | | |
|---|---|---|---|---|
| CN | 205110328 | U | 3/2016 | |
| DE | 2435777 | A1 | 2/1976 | |
| DE | 102007060335 | A1 * | 6/2009 | B30B 11/08 |
| DE | 102015105936 | B4 | 7/2017 | |
| JP | S63-299893 | A | 12/1988 | |
| RU | 2488489 | C1 | 7/2013 | |
| WO | 99/25545 | A1 | 5/1999 | |

* cited by examiner

ROTOR FOR A ROTARY PRESS

CROSS REFERENCE TO RELATED INVENTION

This application is based upon and claims priority to, under relevant sections of 35 U.S.C. § 119, German Patent Application No. 10 2018 122 394.3, filed Sep. 13, 2018, the entire contents of which are hereby incorporated by reference.

BACKGROUND

The invention relates to a rotor for a rotary press for pressing a product into pellets comprising a die plate with die holes that is rotationally driven by means of a rotary drive, an upper punch seat that rotates in sync with the die plate to axially guide upper punches, as well as a lower punch seat that rotates in sync with the die plate to axially guide lower punches.

Such a rotor is for example known from DE 10 2015 105 936 B4. In rotary presses, generally a powdered product is pressed into pellets such as tablets. During the pressing process, process residue (e.g., dust or powder) arises that in particular collects on the top side of the die plate and the top side of the lower punch seat. Suction lines of suction apparatuses that suck up the product residue are positioned at several positions of the rotor, in particular several positions of the die plate and the lower punch seat. The entire pressing chamber can become contaminated by the product residue. The cleaning effort is correspondingly high, and dirt-sensitive, or respectively dust-sensitive components must be protected in particular, for example by individual covers. In order to minimize product dust from spreading, high vacuum performance is required. On the one hand, this impairs efficiency and can on the other hand lead to undesirable product loss in the region of the die plate. In particular in the region of the suction units, the product residue is also stirred up and can be distributed undesirably in the pressing chamber.

Based on the explained prior art, the object of the invention is to provide a rotor of the aforementioned type with which, in a structurally simple manner, reliable product residue removal is possible with a minimized danger of contaminating the pressing chamber.

BRIEF SUMMARY OF THE INVENTION

For a rotor of the aforementioned type, the invention solves the object in that a fixed, annular discharge channel is provided that, during the operation of the rotor, collects product residue from the die plate and/or from the lower punch seat, the discharge channel has a removal region from which the product is removed, and a catch element is provided which rotates in sync with the die plate, is guided in the discharge channel, and conveys the product located in the discharge channel to the removal region.

The rotor according to the invention is used in a rotary press in which a generally powdered product is pressed into pellets, for example into tablets. By means of a rotary drive, a die plate with die holes is rotatably driven. An upper punch seat for axially guiding upper punches and a lower punch seat for axially guiding lower punches rotate in sync with the die plate. The rotor according to the invention can also comprise upper punches and lower punches that rotate in sync with the die plate and are assigned to the die holes in pairs. The lower punch seat comprises a plurality of holes in which the lower punches are accommodated.

Correspondingly, the upper punch seat comprises a plurality of holes in which the upper punches are accommodated. The upper and lower punches interact in the holes in the die plate to press the product. The lower punch seat can comprise an annular top side. The upper punch seat can comprise an annular bottom side. The top side of the lower punch seat can lie in a preferably horizontal plane. The bottom side of the upper punch seat can also lie in a preferably horizontal plane. The top side of the punch seats and the bottom side of the upper punch seat can lie in planes that are parallel with each other. The die plate also generally comprises a top side lying in a preferably horizontal plane and a bottom side that generally lies parallel to the top side and accordingly also lies in a preferably horizontal plane. The top side of the lower punch seat, the bottom side of the upper punch seat, and the top and bottom side of the die plate can in particular lie in planes that are parallel to each other. Moreover, the rotor can comprise a top control cam that controls the axial movement of the upper punch running across the upper control cam, as well as a bottom control cam that controls the axial movement of the lower punch running across the bottom control cam. The rotor also has a drive for rotating the die plate with the upper punch seat and the lower punch seat. The upper and lower punches interact in a known manner in the holes in the die plate to press the product into pellets. The die plate can be a closed ring disk or be formed from ring segments. The die holes can be formed by die sleeves that are releasably inserted into the die plate, or by holes that are directly introduced into the die plate.

The invention also relates to a rotary press, in particular a rotary tablet press, with a rotor according to the invention. The rotary press then furthermore comprises at least one filling apparatus in which the product to be pressed is filled into the holes in the die plate. The filling apparatus can for example have a so-called filling shoe by means of which the product falls into the holes under gravity. In addition, the rotary press comprises at least one pressing apparatus, that for example can comprise upper and lower compression rollers, in which the punches are pressed toward each other in the holes in the die plate to press the product. After passing through the pressing apparatus, the upper punches, guided by the top control cam, are retracted out of the holes, and the lower punches, guided by the lower control cam, are moved upward to eject the pellets produced in the holes. In a downstream scraping apparatus of the rotary press, the tablets can be scraped off of the top side of the die plate toward one or more discharge channels by means of which the pellets are removed from the rotary press.

According to the invention, an annular, fixed discharge channel is provided. Unpressed product that for example can be powder or dust is located in particular on the top side of the die plate and on the top side of the lower punch seat. From there, the product preferably passes at least mainly, in particular almost entirely into the discharge channel under centrifugal force and gravity. In particular due to the rotation of the rotor, the product is conveyed away radially under centrifugal force to the outside of the top side of the die plate, or respectively the lower punch seat, and then falls under gravity into the discharge channel. The discharge channel has a removal region from which the product is removed in particular through a removal opening in the removal region. According to the invention, a catch element is also provided that rotates with the die plate and is arranged in the discharge channel and is guided therein during rotation. The catch element entrains product located in the discharge channel and conveys it to the removal region from where it is removed, for example out of the pressing chamber of the rotary press into a scrap or recycling container. The catch element rotates together with the rotor, in particular with the die plate and the upper and lower punch seat in the fixed, i.e., non-rotating discharge channel. In this case, the catch element can scrape the product like a scraper off the floor of the discharge channel and convey it to the removal region. In this case, the catch element rotates through the removal region. A thermoplastic for example such as polyoxymethylene (POM) can be the material for the catch element.

According to the invention, the product is accordingly discharged partially mechanically to the removal region from where it is then removed. Since the product is fed to the discharge channel in particular under centrifugal force and gravity on the one hand, and the product is conveyed mechanically on the other hand in the discharge channel to the removal region, it is unnecessary, in contrast to the prior art, to provide greater vacuum output close to the die plate or the lower punch seat, in particular at several points. Instead, a single removal region is sufficient from which the product which is mechanically delivered thereto is removed. Regions that can be contaminated in the pressing chamber from excess product, in particular from product dust, are thereby minimized. Instead, there is a definite airflow specifically in the region of the removal region. Additional coverings of dirt-sensitive components that are necessary in the prior art are not required, and the surfaces to be cleaned and hence the cleaning effort are reduced. Efficiency is increased on the one hand since there is less required vacuum performance. On the other hand, there is no swirling of excess product which may occur in the prior art, or there is no undesirable suction and hence product loss in the region of the die plate.

According to an embodiment, the removal region can be a suction region, wherein a suction apparatus is provided that sucks product out of the suction region. The suction apparatus can reinforce or assist the delivery of the product to the discharge channel. In particular, the suction apparatus can generate a vacuum that extends into the region of the discharge channel, which supports the delivery of the product residue into the discharge channel. This is, however, not essential. As explained, it is in particular possible for the product to be delivered to the discharge channel exclusively under centrifugal force and gravity. The catch element in this case rotates through the suction region; given the suction effect of the suction apparatus, the product entrained by the catch element is sucked out of the suction region in this case.

Of course, the discharge channel according to the invention can also have several removal regions, in particular suction regions. These can then each be connected to a suction apparatus. It is, however, also possible to provide a suction apparatus for several suction regions. Of course, several catch elements can also be provided.

According to one embodiment, at least the floor of the discharge channel can be arranged in a plane below the top side of the lower punch seat. In particular, the entire discharge channel can be arranged in a region below the top side of the lower punch seat. The discharge channel, or respectively its floor is thus also located below the die plate which is arranged above the top side of the lower punch seat. In this embodiment, the product falls very easily and directly into the annular peripheral discharge channel. The discharge channel can for example be arranged on the outer edge of the die plate, or respectively the lower punch seat. It can be located below the lower punch seat and in a region that is completely radially to the outside of the die plate, or respectively the lower punch seat, or partially overlaps with the die plate and/or the lower punch seat in a radial direction.

According to a particularly practical embodiment, the discharge channel can be a discharge groove. The discharge groove can for example comprise a U-shaped cross-section.

According to another embodiment, the catch element can be elastic. It can then for example adjoin the floor and/or walls of the discharge channel with slight elastic deformation and thus entrain the product in a particularly reliable manner.

According to another embodiment, the maximum width of the catch element can substantially correspond to the width of the discharge channel According to another embodiment, a bottom side of the catch element can adjoin the floor of the discharge channel, in particular during rotation. The shape of the catch element can be adapted to the cross-section of the discharge channel in order to further optimize the entraining effect. In particular, the catch element can adjoin the floor and the walls of the discharge channel as already explained.

According to another embodiment, the catch element can be fastened to the lower punch seat. The concomitant rotation of the catch element is thus realized in a manner that is particularly easy to construct.

A covering can moreover be provided that at least encloses, in particular encloses annularly, the die plate, the lower punch seat and the discharge channel. The covering can in particular tightly seal the die plate, the lower punch seat and the discharge channel against the exit of powder or dust. By means of such a covering arranged at a gap, preferably a short gap from the enclosed components, spreading of product residue in the pressing chamber is very reliably prevented.

According to an embodiment, the suction apparatus may comprise a vacuum apparatus. According to another embodiment, the vacuum apparatus can be provided that generates a vacuum relative to the surroundings of the covering within the region enclosed by the covering. Such a vacuum prevents the exit of product residue, in particular product residue dust.

BRIEF DESCRIPTION OF THE DRAWINGS

An exemplary embodiment of the invention is explained below in greater detail with reference to figures. Schematically.

The same reference numbers refer to the same objects in the figures unless indicated otherwise.

DETAILED DESCRIPTION OF THE INVENTION

Figure 1:
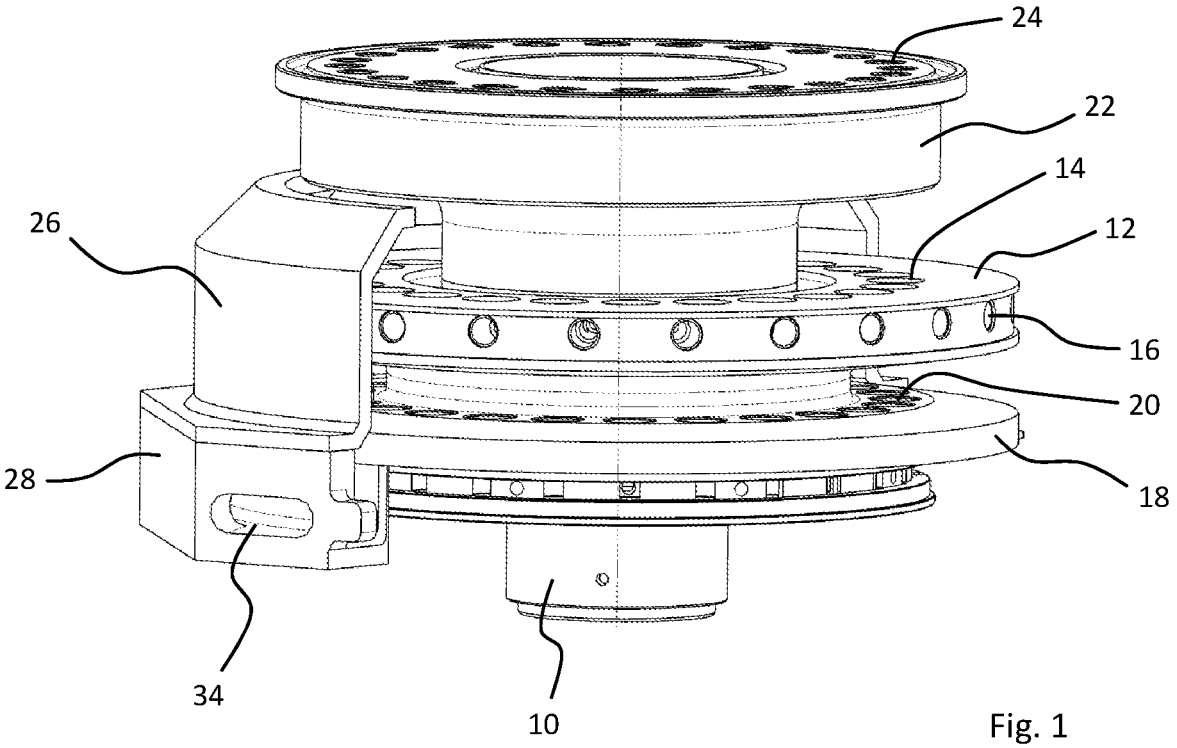
FIG. 1 illustrates a perspective view of an embodiment or a rotor for a rotary press with a partially cut-away covering.

The rotor according to the invention depicted in the FIGS. 1-4 is a rotor of a rotary press, in particular a rotary tablet press for pressing a for example powdered product into pellets such as tablets. As shown, the rotor comprises a drive section 10 that is connected to a rotary drive, which is not shown in greater detail in the figures for reasons of simplicity, to rotate the rotor. A die plate 12 is connected to the drive section 10. The die plate 12 has a plurality of sleeve seats 14 into which die sleeves are inserted in the depicted example that then form die holes in the die plate 12. The die sleeves are also not shown in the figures for reasons of simplicity. The die plate 12 has a plurality of radial holes 16 in the perimeter in which lock screws can be inserted to clamp the die sleeves in the sleeve seats 14. This is known per se. In the shown example, the die plate 12 is formed as a closed ring disk. It could however also be constructed of individual ring segments. It would also be conceivable for the die holes to be formed by holes introduced directly into the die plate 12 instead of the removable die sleeves.

Moreover, a lower punch seat 18 with a plurality of through-holes 20 and an upper punch seat 22, also with a plurality of through-holes 24, is connected to the drive section 10. While the rotor is operating, lower punches are guided axially in the through-holes 20 of the lower punch seat 18, and upper punches are guided axially in the through-holes 24 of the upper punch seat 22. By means of upper and lower control cams of the rotary press, the axial movement of the upper and lower punches is controlled in a manner known per se such that they interact to press the product in the die holes, also in a manner known per se. The rotary drive rotates the die plate 12, the lower punch seat 18, and the upper punch seat 22 in sync during operation.

Figure 2:
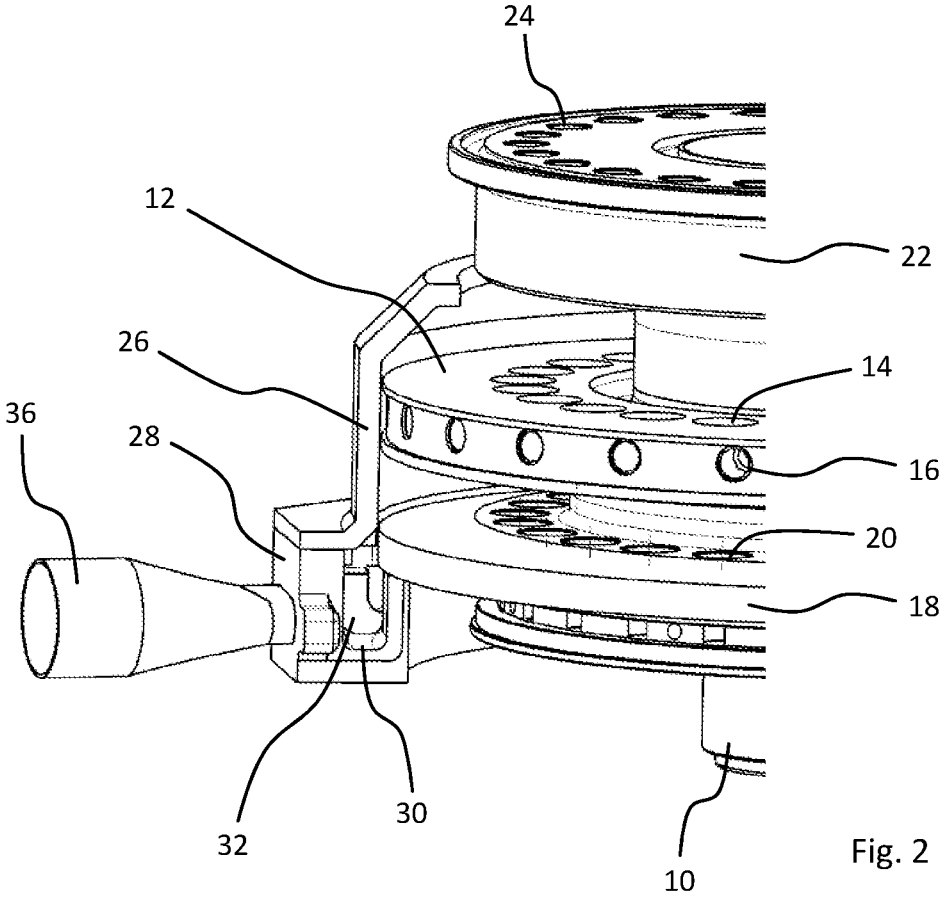
FIG. 2 illustrates a close-up view of an embodiment of the rotor for a rotary press with a partially cut-away covering.
Figure 3:
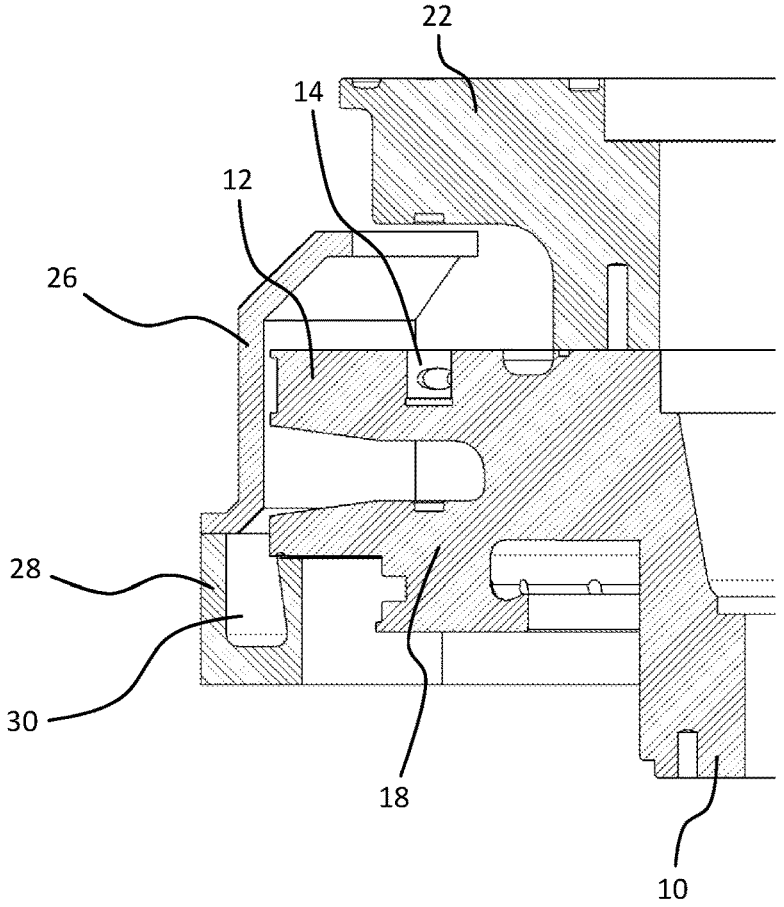
FIG. 3 illustrates a sectional view of the embodiment of the rotor of a rotary press from FIG. 2.
Figure 4:
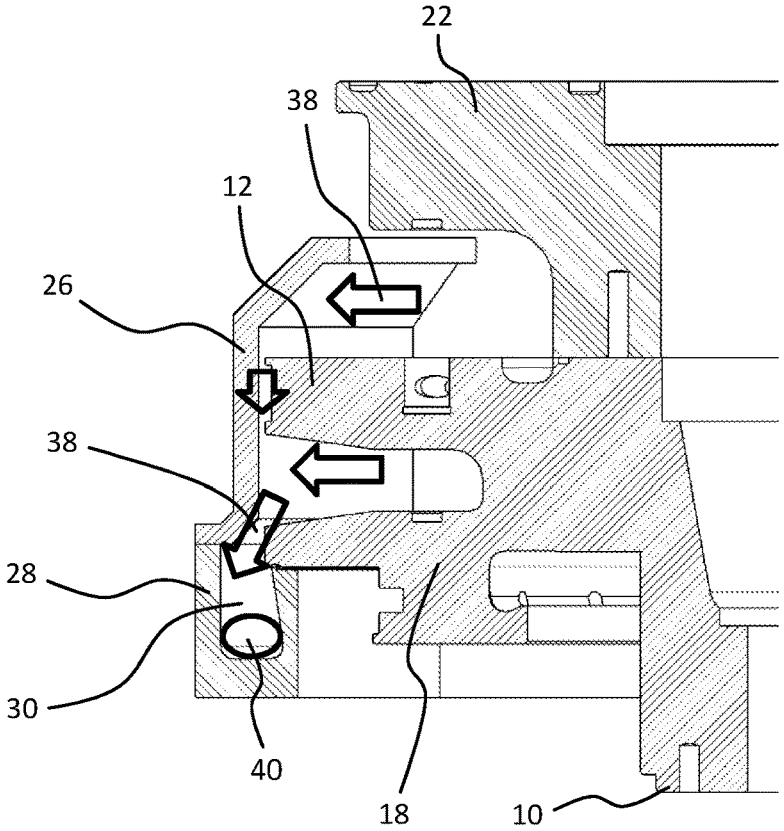
FIG. 4 illustrates a sectional view of the embodiment of the rotor of a rotary press from FIG. 2.

At reference signs 26 and 28, a covering of the rotor is discernible in FIG. 1 that is partially cut away for reasons of clarity is formed from two sections and annularly encloses the die plate 12 and the lower punch seat 18 as well as an annularly surrounding discharge channel 30 (FIGS. 2-4). As shown, the discharge channel 30 (FIGS. 2-4) is configured as a discharge groove and is located in the region of the outer edge of the lower punch seat 18 below the lower punch seat. As is clearly discernible in particular in the sectional view in FIG. 3, there is a gap between the outer edge of the die plate 12 as well as the lower punch seat 18 and the upper section 26 of the covering 26, 28. As already explained, the discharge channel 30 bordered by the bottom section 28 of the covering 26, 28 runs annularly. The covering 26, 28 and hence the discharge channel 30 are fixed, i.e., do not rotate when the rotor rotates.

In FIG. 2, a catch element 32 is also discernible whose shape is adapted to the cross-section of the discharge channel 30. The catch element 32 is fastened to the lower punch seat 18 in the depicted example so that it rotates therewith. During this rotation, the catch element 32 is guided in the discharge channel 30. In the shown example, the catch element 32 is elastic and preferably also lies against the side walls of the discharge channel 30, at least on the floor of the discharge channel 30. In FIG. 1, a suction opening 34 is also discernible in the bottom section 28 of the covering 26, 28 that forms a suction region. In FIG. 2, it is discernible that a suction connector 36, which is not depicted in FIG. 1 for display reasons, is attached to this suction opening 34. A suction apparatus is connected to this suction connector 36 which is not depicted in the figures in greater detail for reasons of simplicity.

While the rotor is operating, the in particular powdered product is pressed into pellets in the die holes as explained. In so doing, product residue (e.g., dust or powder) inevitably accumulates on the top side of the die plate 12 and on the top side of the lower punch seat 18. Due to the rotation of the die plate 12 and the lower punch seat 18, this product residue first passes radially to the outside due to centrifugal force and then falls downward into the discharge channel 30 under gravity through the explained gap between the outer edges of the die plate 12 and lower punch seat 18 and the covering 26, 28. The movement of the product residue is illustrated in FIG. 4 by the arrows 38. At reference sign 40, a schematically enlarged accumulation of product residue is depicted on the floor of the discharge channel 30. The product residue located in the discharge channel 30 is entrained by the catch element 32 which rotates with the rotor during operation and is in particular transported into the suction region defined by the suction opening 34 where the product residue is sucked out through the suction connector 36 by the suction apparatus, for example to a scrap or recycling container. A slight vacuum can be produced by the suction apparatus within the covering 26, 28 as well that prevents the product residue from passing outward out of the region enclosed by the covering 26, 28. This is however not essential.

LIST OF REFERENCE SIGNS

10 Drive section
12 Die plate
14 Sleeve seats
16 Radial holes
18 Lower punch seat
20 Through holes
22 Upper punch seat
24 Through holes
26 Covering
28 Covering
30 Discharge channel
32 Catch element
34 Suction opening/suction region
36 Suction connector
38 Arrows
40 Accumulation

The invention claimed is:

1. A rotor for a rotary press comprising:

a die plate defining a plurality of die holes and configured to be rotationally driven;

an upper punch seat configured to axially guide a set of upper punches, wherein the upper punch seat is configured to be rotationally driven to rotate in sync with the die plate;

a lower punch seat configured to axially guide a set of lower punches, wherein the lower punch seat is configured to be rotationally driven to rotate in sync with the die plate;

an annular discharge channel in a fixed position with respect to the die plate, the annular discharge channel configured to collect product residue from at least one of the die plate and the lower punch seat, wherein the annular discharge channel comprises a removal region where the product residue is configured to be removed from the annular discharge channel; and a catch element in a form of a scraper is adjoined to a floor of the annular discharge channel to scrape the produce residual from the floor, wherein the catch element is configured to rotate in sync with the die plate, wherein the catch element is guided within the annular discharge channel and moves relative to the floor of the annular discharge channel to convey the product residue collected in the annular discharge channel to the removal region.

2. The rotor according to claim 1, further comprising a suction apparatus configured to suction the product residue away from the removal region.

3. The rotor according to claim 1, wherein the floor of the annular discharge channel is located in a plane below a top side of the lower punch seat.

4. The rotor according to claim 1, wherein the annular discharge channel is a discharge groove.

5. The rotor according to claim 3, wherein the catch element comprises an elastic material.

6. The rotor according to claim 5, wherein a maximum width of the catch element substantially corresponds to a width of the annular discharge channel.

7. The rotor according to claim 6, wherein a bottom side of the catch element contacts the floor of the annular discharge channel.

8. The rotor according to claim 1, wherein the catch element is coupled to the lower punch seat.

9. The rotor according to claim 1, further comprising a covering configured enclose the die plate, the lower punch seat and the annular discharge channel.

10. The rotor according to claim 1, further comprising:

a covering configured to surround and enclose a region that includes the rotor; and a vacuum apparatus configured to generate a vacuum within the region enclosed by the covering.

11. The rotor according to claim 2, wherein the suction apparatus comprises a vacuum apparatus.

12. The rotor according to claim 11, further comprising a covering configured to surround and enclose a region including the rotor, wherein the vacuum apparatus is configured to generate a vacuum within the region enclosed by the covering.

* * * * *